US006726010B2

(12) United States Patent
Kaminstein

(10) Patent No.: US 6,726,010 B2
(45) Date of Patent: Apr. 27, 2004

(54) TOILET BOWL BRUSH AND HOLDER

(75) Inventor: Bruce Kaminstein, Blauvelt, NY (US)

(73) Assignee: Kaminstein Imports, Inc., Blauvelt, NY (US)

( * ) Notice: Subject to any disclaimer, the term of this patent is extended or adjusted under 35 U.S.C. 154(b) by 0 days.

(21) Appl. No.: 10/142,445

(22) Filed: May 9, 2002

(65) Prior Publication Data

US 2003/0209458 A1 Nov. 13, 2003

(51) Int. Cl.[7] ..... A45D 44/18

(52) U.S. Cl. ..... 206/361; 206/362.2; 211/65; 248/110

(58) Field of Search ..... 206/15.3, 361, 206/362.3; D6/551; 211/60.1, 62, 65, 66, 70.6; 248/110; 220/736

(56) References Cited

U.S. PATENT DOCUMENTS

| | | | | | |
|---|---|---|---|---|---|
| 750,357 | A | | 1/1904 | Gibbons | |
| 1,154,369 | A | | 9/1915 | Browning | |
| D81,300 | S | | 6/1930 | Pohlson | |
| 2,757,787 | A | * | 8/1956 | Sergent | 206/361 |
| 3,085,678 | A | * | 4/1963 | Moore | 206/361 |
| 3,225,375 | A | | 12/1965 | Atkinson et al. | |
| 3,361,507 | A | * | 1/1968 | O'Neil | 312/206 |
| D221,506 | S | | 8/1971 | O'Neil et al. | |
| D233,196 | S | | 10/1974 | Fry | |
| 4,025,982 | A | | 5/1977 | Palmer | |
| 4,031,673 | A | | 6/1977 | Hagelberg | |
| D272,874 | S | | 3/1984 | Cohen | |
| D298,712 | S | | 11/1988 | Mattei | |
| D315,269 | S | | 3/1991 | Brazis | |
| 5,228,580 | A | * | 7/1993 | Grange | 211/70.6 |
| D345,271 | S | | 3/1994 | Vetter | |
| D360,986 | S | | 8/1995 | Hoagland | |
| D362,575 | S | | 9/1995 | Bird et al. | |
| D394,353 | S | | 5/1998 | Berti | |
| 5,890,588 | A | | 4/1999 | Leonard et al. | |
| 5,941,379 | A | | 8/1999 | Barardo | |
| 5,984,555 | A | | 11/1999 | Samad | |
| 6,094,765 | A | | 8/2000 | Askenase | |
| 6,134,738 | A | | 10/2000 | Weber et al. | |
| 6,419,106 | B1 | * | 7/2002 | Bebak | 220/570 |

FOREIGN PATENT DOCUMENTS

| | | |
|---|---|---|
| EP | 329938 A1 | 8/1989 |

* cited by examiner

*Primary Examiner*—David T. Fidei
(74) *Attorney, Agent, or Firm*—Stephen E. Feldman, PC

(57) ABSTRACT

A combination toilet bowl cleaning brush and a brush holder includes a toilet bowl cleaning brush with a brush head, a non-flexible shaft and a bulbous handle. The non-flexible shaft extends linearly from the brush head to a positively curved portion and thence to a second linear portion that connects to the bulbous handle. The brush holder includes a circular, flat surface base and a cylindrical wall rising from the base. The cylindrical wall which extends around less than half of a minor circumference of the base rises linearly from the base to a negative curved portion, the upper end of the wall covering a radius of the base. The upper end of the cylindrical wall includes an open groove for receiving the shaft of the cleaning brush. The positive curved shaft and the negative curved wall intersect at the open groove, securing the cleaning brush in the brush holder.

5 Claims, 2 Drawing Sheets

TOILET BOWL BRUSH AND HOLDER

BACKGROUND OF THE INVENTION

1. Field of the Invention

The present invention relates to toilet bowl cleaning brush and brush holder combination. More particularly, the invention relates to a toilet bowl cleaning brush with a curved shaft between the brush and the handle which provides for under-the-rim cleaning without reaching into the toilet bowl. The curvature of the shaft also cooperates with a curvature in the wall of the brush holder for securing the brush in the brush holder.

2. Prior Art

Cleanliness in a household is often centered on the sanitary condition of the toilet bowl in the bath room of the house. The cleaning of a toilet bowl, in the bath room, is often considered the task of house cleaning. A brush secured at the end of an elongated handle is usually used for cleaning a toilet bowl. Cleaning chemicals, which are often used when cleaning such bowls, tend to stain the bowls and hard water retained in the bowel usually leaves an undesirable residue in the bowl. The prior art is replete with teachings related to toilet bowl cleaning brushes but fail to address the combined problem of stand-off cleaning and storage of the cleaning brush.

An example of some utility patents issued in the field of the invention are:

U.S. Pat. No. 750,357 issued to Gibbons, Dec'd Jan. 26, 1904

U.S. Pat. No. 1,154,369 issued to Browning Sep. 21, 1915

U.S. Pat. No. 3,225,375 issued to Atkinson, et al Dec. 28, 1965

U.S. Pat. No. 4,025,982 issued to Palmer May 31, 1977

U.S. Pat. No. 5.890,588 issued to Leonard, et al Apr. 06, 1999

U.S. Pat. No. 5,941,379 issued to Barardo Aug. 24, 1999

U.S. Pat. No. 5,984,555 issued to Samad Nov. 16, 1999

U.S. Pat. No. 6,094,765 issued to Askenase Aug. 01, 2000

U.S. Pat. No. 6,134,738 issued to Weber, et al Oct. 24, 2000

European Patent #329,938 issued to Weihrauch Aug. 30, 1989

An example of some design patents that have issued in the related field are:

U.S. Des. Pat. No. 221,506 issued to O'Neil, et al Aug. 24, 1971

U.S. Des. Pat. No. 272,874 issued to Cohen Mar. 06, 1984

U.S. Des. Pat. No. 360,986 issued to Hoagland Aug. 08, 1995

U.S. Des. Pat. No. 394,353 issued to Berti May 19, 1998

The U.S. Pat. No. 750,357, issued to Gibbons, Des'd, on Jan. 26, 1904 teaches a brush for cleaning traps of house tanks, basins and toilet bowls. The brush is attached to a flexible, extendible shaft with a rigid handle at the opposite end of the flexible shaft. The flexible portion is a spring-like element in a flexible tubing. The U.S. Pat. No. 1,154,369 issued to Browning teaches a toilet bowl cleaning brush connected to the end of a flexible, hollow member, which is connected to a ridged tubular member. A movable rod-like extension which passes through the ridged tubular member, is extendible to the base of the brush for straightening the flexible, hollow member. U.S. Pat. No. 3,225,375 issued to Atkinson, et al teaches a cleaning device which has a handle with an angular bend near the end of the shaft defining the handle and a second angular bend at the end thereof. The extension of the second angular bend is a hinged, slip-on head which receives a replaceable brush element. U.S. Pat. No. 4,025,982, to Palmer teaches a device for cleaning toilets in which a flexible plastic material, defined by a plurality of spaced balls in a flexible tubing is connected to a brush, at one end and a handle at the other end. The European patent #329,938 issued to Weihrauch, teaches a brush connected to a shaft and handle with a brush holder. A collar on the shaft cooperates with a slot in the top of the holder to keep the brush suspended in the holder. The U.S. Pat. No. 5,890,588 to Leonard, et al teaches a toilet brush with a sealable storage container which, when a toilet brush is inserted into the storage container may be sealed closed. The toilet brush is a straight handled brush. U.S. Pat. No. 5,941,379 issued to Barardo teaches a toilet bowl cleaning device which includes a straight handled brush and brush head holder. The bolder is a container which contains a cleaning solution into which the brush is inserted. The U.S. Pat. No. 5,984,555 issued to Samad teaches a toilet cleaning brush which has twin heads. One head, of the twin heads, is an extension of the other head, both heads being at the same end of the brush. The handle is defined by an enlargement in the hollow shaft with a movable rod that passes through the hollow shaft. The U.S. patent to Askenase, U.S. Pat. No. 6,094,765 teaches a toilet cleaning rod which includes a straight shaft with a 180 degree bend at one end defining a handle and a 90 degree bend at the other end defining the cleaning tool. U.S. Pat. No. 6,134,738, issued to Weber, et al teaches a toilet cleaning brush which has a handle which includes a journal at one end which accepts a stem of a brush head. This makes the brush head removable from the handle portion of the brush.

The design patent to O'Neil, et al shows a toilet brush and holder in which the holder is a hanger and the brush, which is off-set from the major axis of the handle and extends in a parallel plane, hangs in the holder. The design patent to Cohen, U.S. Des. Pat. No. 272.874 shows a holder and toilet brush combination in which the holder is rectangular with a cutaway face. The brush, a straight handled brush, includes a fade-away back that conforms to the cutaway face of the holder. The design U.S. Des. Pat. No. 360,986, to Hoagland shows a toilet brush handle which includes a straight grip and a dual angled shaft ending in a stud for accepting a brush head. The design patent to Berti shows a toilet bowl brush handle. The handle is straight, rigid, multi bulged and removable from the brush head.

SUMMARY OF THE INVENTION

The present invention provides a combination of a toilet bowl cleaning brush and a holder for the brush. The toilet bowl cleaning brush includes a brush head connected to one end of a rigid shaft, the rigid shaft is connected, at its other end, to a bulbous handle: The shaft has a positively curved portion between its ends. The curve in the shaft provides a cleaning brush in which the bulbous handle and the brush head are in different planes with the major axis of the brush head and the major axis of the bulbous handle forming a virtual angle of between 15 degrees and 22 degrees. This permits the holder of the handle of the cleaning brush to work the brush head under the rim of the toilet bowl without the hand holding the cleaning brush breaking the plane of the top of the toilet bowl. In addition, the invention provides a brush holder for securely retaining the brush in the holder while permitting circulation of air substantially around the brush head for drying the brush head. The brush holder includes a circular base, permitting easy insertion of the bolder into an angular corner. A vertical wall, extending from the base, terminates in an internal groove. The wall extends linearly upward from the base, then curves negatively, that is, inwardly over the base. When the cleaning brush is positioned in the holder, with the brush head on the base and the shaft extending upwardly, with the curve of the shaft extending away from the center of the diameter of the base, the shaft of the brush lies in an overhanging groove in the wall of the brush holder, positively holding the cleaning brush in the brush holder, with the bulbous handle extending from the top of the brush holder.

The wall of the brush holder, extending from the base, extends around a portion of less than one half of the circumference of the base. The measurement of the greatest tangent between the edges of the wall is less than the diameter of the circumference on which the wall lies but more than the diameter of the brush head held in the brush holder. The wall of the holder covers a sufficient portion of the brush head to hide the brush head from view while providing sufficient ventilation for the brush head to air out and dry. The circular, flat base has a diameter that is somewhat larger than the diameter of the brush head. Thus, when the brush holder, with the toilet bowl cleaning brush held therein, is positioned in the corner of a room, for example, the bathroom, the brush head of the toilet bowl cleaning brush is hidden from view. This hideaway feature of the combination toilet bowl cleaning brush and brush holder is not addressed in the prior art. The curved shaft on the cleaning brush works together with the curved upper wall and upper groove of the brush holder for securing the brush in the holder and provides off-set cleaning of the rim of a toilet bowl without the necessity of the hand of the person using the toilet bowl cleaning brush breaking the plane of the top of the toilet bowl, while cleaning the toilet bowl. The extent of the wall around a portion of the circumference of the base covers and hides the brush head from view, while permitting adequate ventilation for permitting the brush head to dry out.

DETAILED DESCRIPTION OF THE INVENTION

Figure 1:
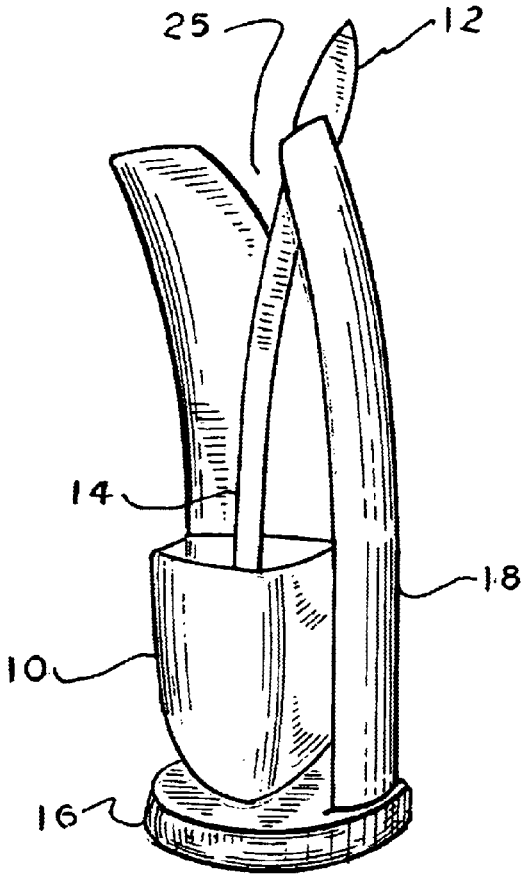
FIG. 1 is a pictorial representation of the invention showing the toilet bowl cleaning brush in the holder.

Throughout the detailed description of the invention, referenced to the drawings, identical elements shown in the drawings are identified by identical call-out numbers. In the drawings, the elements of the invention are pictorially represented in a preferred embodiment of the invention. Referring to FIG. 1, a toilet bowl cleaning brush, which includes the brush head 10, the bulbous handle 12 and the shaft 14, is represented positioned in a brush holder defined by a base 16 and extending, partial cylindrical wall 18. The shaft 14, connected to the brush 10 at one end and to the bulbous handle 12 at the other end, is a non-flexible shaft, as is the bulbous handle. The shaft 14 extends linearly from its connection to the brush, to a positive curve between the ends of the shaft. The partial cylindrical wall 18 is connected to the base 16, rising linearly from the base to a negative curve, between the upper and lower ends of the wall 18. When the cleaning brush is positioned in the brush holder, the location of the curve in the wall 18 and location of the curve in the shaft 14 are at approximately the same level 20, above the upper surface of the base 16. The levels 20 of the curves and the relationship between the positive curve in the shaft 14 and the negative curve in the wall 18 and the levels 20 of the curves are clearly seen in FIGS. 3 and 3*a*.

Figure 3:
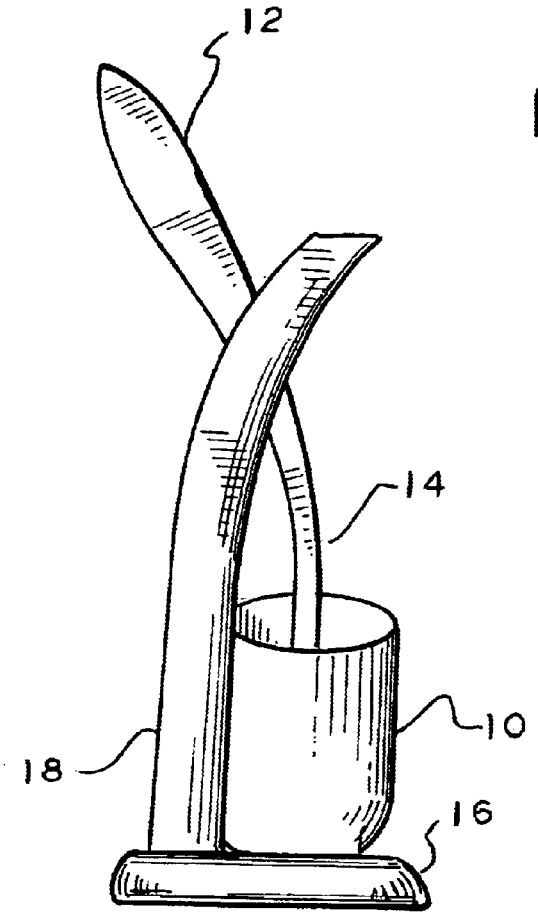
FIG. 3 is a pictorial representation of the invention represented in FIG. 1 as viewed from the side.
Figure 3A:
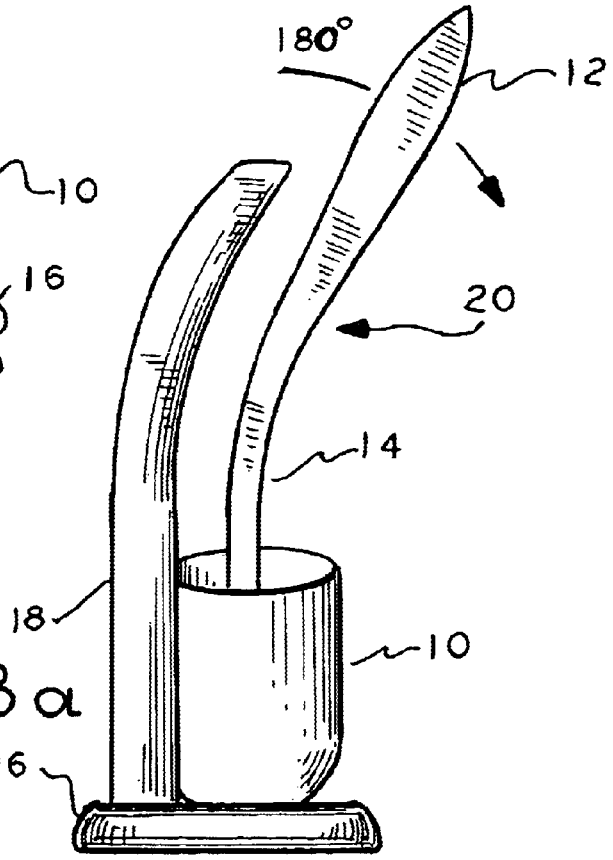
FIG. 3*a* is a pictorial representation of the invention represented in FIG. 3, with the toilet bowl cleaning brush rotated 180 degrees from that shown in FIG. 3.

In FIG. 3, the shaft 14 and the wall 18 intersect, the shaft 14 sitting in a groove 25 of the curved wall. The intersection of the shaft and the wall, which is the result of the positive curve in the shaft 14 and the negative curve in the wall 18, permits the shaft 14 to enter the groove 25 in the upper portion of the wall 18. The negative curve in the wall 18 permits the securing of the shaft 14 in the V-shaped groove 25 thus securing the cleaning brush in the brush holder. The over hang of the wall 18, defined by the curve in the wall 18 hides the brush head from casual view. With the brush head 10 on the base 16 and the shaft 14 positioned in the V-shaped groove 25 in the wall 18, the toilet bowl cleaning brush is secured in the brush holder. In FIG. 3*a* the brush is represented as pivoted 180 degrees from the secure position represented in FIG. 3. The level of the curves in the wall and in the shaft, respectively and the parallel relationship between the curve in the shaft and the curve in the wall are clearly shown.

Figure 2:
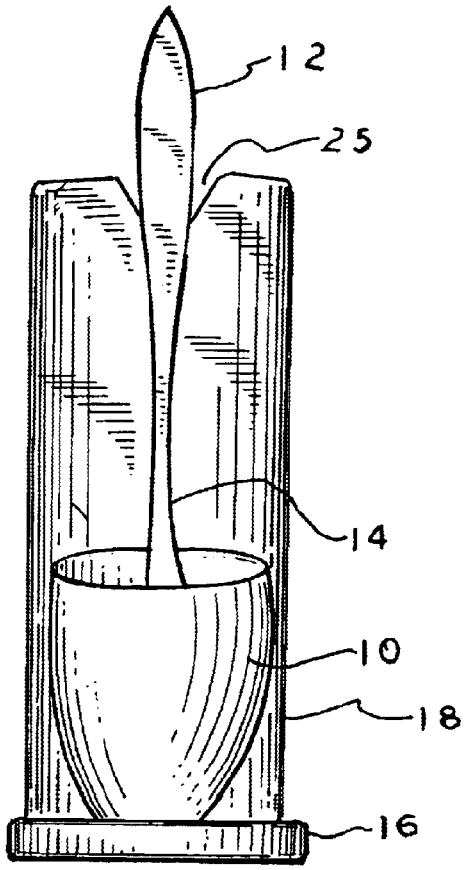
FIG. 2 is a pictorial representation of the invention represented in FIG. 1 as viewed from the back side of the invention.

The wall 18 is connected to the base 16, and extends around a portion of a circumference of the base 16, as clearly represented in FIGS. 3 and 3*a*. Preferably, the wall 18 is on a minor circumference of the base 16. Although the distance between the edges of the wall 18 is short of the diameter of circumference on which the wall 18 is connected to the base 16, the wall 18 is sufficiently wide so that the distance between the two edges of the wall 18 exceeds the diameter of the brush head 10, as seen in FIG. 2. The circular, flat base 16 provides a brush holder that will fit in a wide range of angular corners.

The curvature in the wall 18 is represented as a negative curve since the curvature in the wall 18 positions the top of the wall over the center of the base 16. The curvature in the shaft 14 is represented as a positive curve since the curvature in the shaft 14 positions the bulbous handle 12 of the brush over the major circumference of the base 16 when the brush is positioned securely in the groove 25 of the brush holder. Preferably, the degree of the curvature in the shaft and the degree of curvature in the wall are substantially equal and each curve is in the range of from 15 degrees to 22 degrees. When the brush is used to clean a toilet bowl, the person holding the brush by the bulbous handle can clean under the rim of the toilet bowl without the hand of the person holding the brush breaking the plane of the top of the toilet bowl.

In the foregoing description of the invention, referenced to the drawings, certain terms have been used for conciseness, clarity and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented or described.

Having now described a preferred embodiment of the invention, in terms of features, discoveries and principles, along with certain alternative construction and suggested changes, other changes that may become apparent to those skilled in the art may be made, without departing from the scope of the invention defined in the appended claims.

What is claimed is:

1. A combination cleaning brush and brush holder comprising:

a. a cleaning brush comprising:

a brush head;

a handle;

a shaft connecting said head to said handle, said shaft being non-flexible;

said shaft comprising i. a first linear portion extending from said brush head to a first end;

ii. a positive curve portion connected to said first linear portion at said first end, said positive curve extending to a second end;

iii. a second linear portion connected to said positive curve at said second end, said second linear portion extending to a third end, said third end connected to said handle;

b. a brush holder comprising:

a base for supporting said brush holder;

a cylindrical wall connected to a portion of a minor circumference of said base, said cylindrical wall comprising:

i. a first linear portion extending from said base to a first end;

ii. a negative curve portion connected to the first end of said first linear portion, said negative curve extending to a second end; and iii. a second linear portion, connected to said negative curve at said second end, said second linear portion extending to a third end;

wherein said positive curve being substantially equal to said negative curve; and wherein said cylindrical wall covering a radius of said base; and c. a groove in said cylindrical wall for receiving said second linear portion of said shaft when said cleaning brush is secured in said brush holder;

wherein said positive curve in said brush being located at the same level of said negative curve in said holder so that said shaft of said brush being secured within said groove when said brush being stored in said holder.

2. The combination cleaning brush and brush holder of claim 1, in which said handle is a bulbous handle and extends from said second linear portion of said shaft.

3. The combination cleaning brush and brush holder of claim 1, in which said cylindrical wall extends around a portion of a minor circumference of said base and a distance between a first edge of said cylindrical wall and a second edge of said cylindrical wall is less than a diameter of said minor circumference.

4. The combination cleaning brush and brush holder of claim 3, in which said distance between said first and said second edge exceeds a diameter of said brush head.

5. The combination brush and brush holder of claim 4, and in which said cleaning brush means is a toilet bowl cleaning brush.

* * * * *